US005624250A

United States Patent [19]

Son

[11] Patent Number: 5,624,250

[45] Date of Patent: Apr. 29, 1997

[54] TOOTH PROFILE FOR COMPRESSOR SCREW ROTORS

[75] Inventor: Kil-Won Son, Seoul, Rep. of Korea

[73] Assignee: Kumwon Co., Ltd., Rep. of Korea

[21] Appl. No.: 531,041

[22] Filed: Sep. 20, 1995

[51] Int. Cl.[6] ..... F04C 18/16

[52] U.S. Cl. ..... 418/150; 418/201.3

[58] Field of Search ..... 418/150, 201.3

[56] References Cited

U.S. PATENT DOCUMENTS

| | | | |
|---|---|---|---|
| 4,412,796 | 11/1983 | Bowman | 418/201.3 |
| 4,435,139 | 3/1984 | Astberg | 418/150 |
| 4,508,496 | 4/1985 | Bowman | 418/201.3 |
| 4,576,558 | 3/1986 | Tanaka et al. | 418/150 |
| 4,890,991 | 1/1990 | Yoshimura | 418/201.3 |

FOREIGN PATENT DOCUMENTS

| | | |
|---|---|---|
| 1197432 | 7/1970 | United Kingdom . |
| 2092676 | 8/1982 | United Kingdom . |

*Primary Examiner*—John J. Vrablik

[57] ABSTRACT

An improved tooth profile for compressor screw rotors is disclosed. In the tooth profile, the following-side first curve of the male rotor is generated using a generation parameter of a quadratic function $f(x)=a_{10}x^2+b_{10}x+c_{10}$ whose constants are optimized to meet specified constraint conditions. The above constraint conditions include an increased pressure angle for achieving good cutting condition of the rotors, a sealing surface suitable for minimizing the negative torque applied to a following rotor due to the gas pressure in the trapped pocket volume defined between the rotors, a large surface contact between the two rotors for improving the sealing effect as well as the durability of the rotors, and a minimized specific sliding at the driving force transmission part of the rotors for reducing the operational vibration and noise of the rotors.

3 Claims, 5 Drawing Sheets

FIG. 1
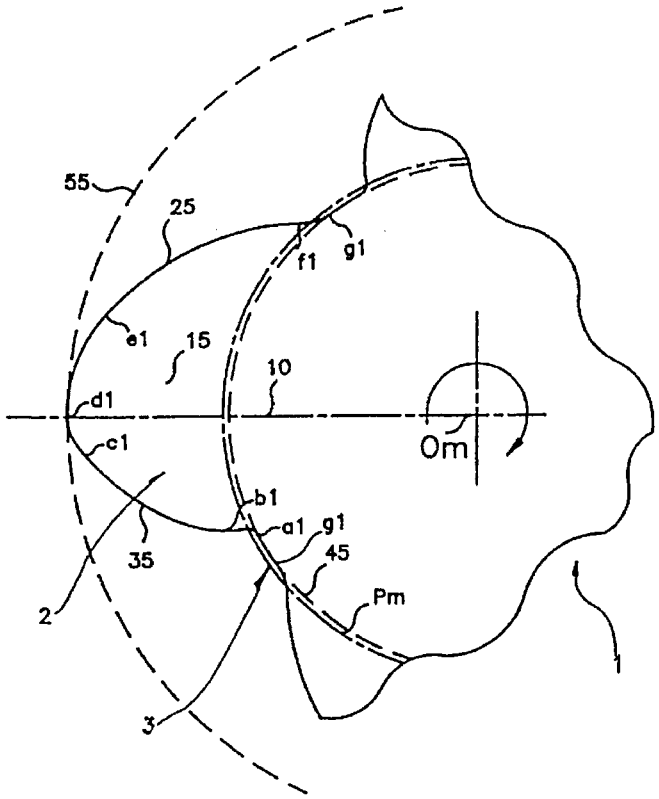
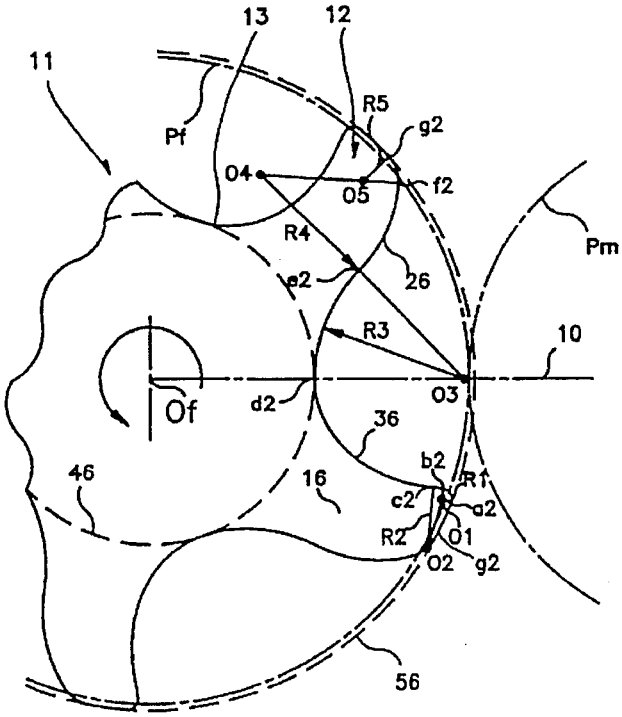
FIG. 2

TOOTH PROFILE FOR COMPRESSOR SCREW ROTORS

BACKGROUND OF THE INVENTION

1. Field of the Invention

The present invention relates in general to compressor screw rotors for feeding compressible gas or fluid while compressing or expanding them and, more particularly, to an improvement in tooth profiles of helical or screw rotors having lands and grooves meshing each other in a compressor casing for improving the operational performance of the compressor. The rotor's tooth profiles are generated using a quadratic function with optimized constants as generation parameters.

2. Description of the Prior Art

Conventionally, a gas compressor for feeding compressible gas or fluid while compressing or expanding them includes a pair of asymmetric screw rotors, that is, male and female screw rotors. The major portions of the female screw rotor are positioned in the inside of its pitch circle, while the major portions of the male screw rotor are positioned in the outside of its pitch circle.

More recently, the tooth profile of screw rotors for compressors have been actively studied. For example, U.S. Pat. No. 4,412,796 and U.K. Patent Nos. 1,197,432 and 2,092,676 disclose screw rotors suitable for improving the operational performance of the compressor.

That is, the above patents disclose use of asymmetric male and female screw rotors instead of conventional symmetric screw rotors and thereby improving the operational efficiency of the compressor. In the screw rotors disclosed in the above patents, the tooth profiles of the male and female screw rotors are asymmetric relative to the radial lines extending from the rotor's centers of rotation and passing through the lowest positions of the grooves.

However in the above male and female screw rotors, the deddendum of each groove of the male screw rotor is relatively larger than the outer diameter of the female screw rotor. Additionally, the addendum of each land of the female rotor is relatively larger than the outer diameter of the female screw rotor. Such larger deddendum and addendum of the male and female rotors provide advantage in that they not only increase the working space volume but also improve the drive conditions of the female rotor. However, the rotors having the above larger deddendum and addendum are problematic in that both the addendum and deddendum enlarge the blow hole and thereby reduce volume efficiency as well as adiabatic efficiency.

Additionally, the screw rotors disclosed in the U.K. Patent No. 1,197,432 have a portion with pressure angle of 0°. This portion causes a bad cutting condition in a hob milling process for producing the rotors. In the screw rotors disclosed in either the U.K. Patent No. 1,197,432 or the U.S. Pat. No. 4,412,796, the tooth profile of the following rotor has a point-generated portion which is difficult to be precisely machined. Additionally, the above point-generated portion of the following rotor is severely abraded during operation of the rotors and thereby cause considerable damage to the tooth surface of the rotor. The point-generated portion also increases the trapped pocket volume.

SUMMARY OF THE INVENTION

It is, therefore, an object of the present invention to provide a tooth profile for compressor screw rotors in which the above problems can be overcome and which is generated using a generation parameter of a quadratic function with constants optimized to meet specified constraint conditions and thereby not only achieves good cutting condition, but also improves the operational performance of the compressor.

In order to achieve the above object, the present invention provides an improved tooth profile for compressor screw rotors in which the following-side first curve of the male rotor is generated using a generation parameter of a quadratic function $f(x)=a_{10}x^2+b_{10}x+c_{10}$ whose constants are selected to meet specified constraint conditions. The above constraint conditions are as follows. That is, the pressure angle is necessary to be increased to achieve good cutting condition for producing the rotors. The sealing surface should be set to minimize the negative torque applied to a following rotor due to the gas pressure in the trapped pocket volume defined between the rotors. The rotors should be brought into large surface contact with each other and thereby improve the sealing effect as well as the durability of the rotors. The specific sliding at the driving force transmission part of the rotors is necessary to be minimized to reduce the operational vibration and noise of the rotors.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an enlarged view showing a tooth profile of a male screw rotor generated in accordance with this invention;

FIG. 2 is an enlarged view showing a tooth profile of a female screw rotor generated in accordance with this invention;

FIGS. 4*a* and 4*b* are graphs representing the influence of the constants of the quadratic function used as generation parameters for generating the rotor's tooth profiles of this invention, in which:

FIG. 4*a* is a graph when the constant "a" of the quadratic function varies; and FIG. 4*b* is a graph when the constant "b" of the quadratic function varies;

DESCRIPTION OF THE PREFERRED EMBODIMENTS

Figure 3:
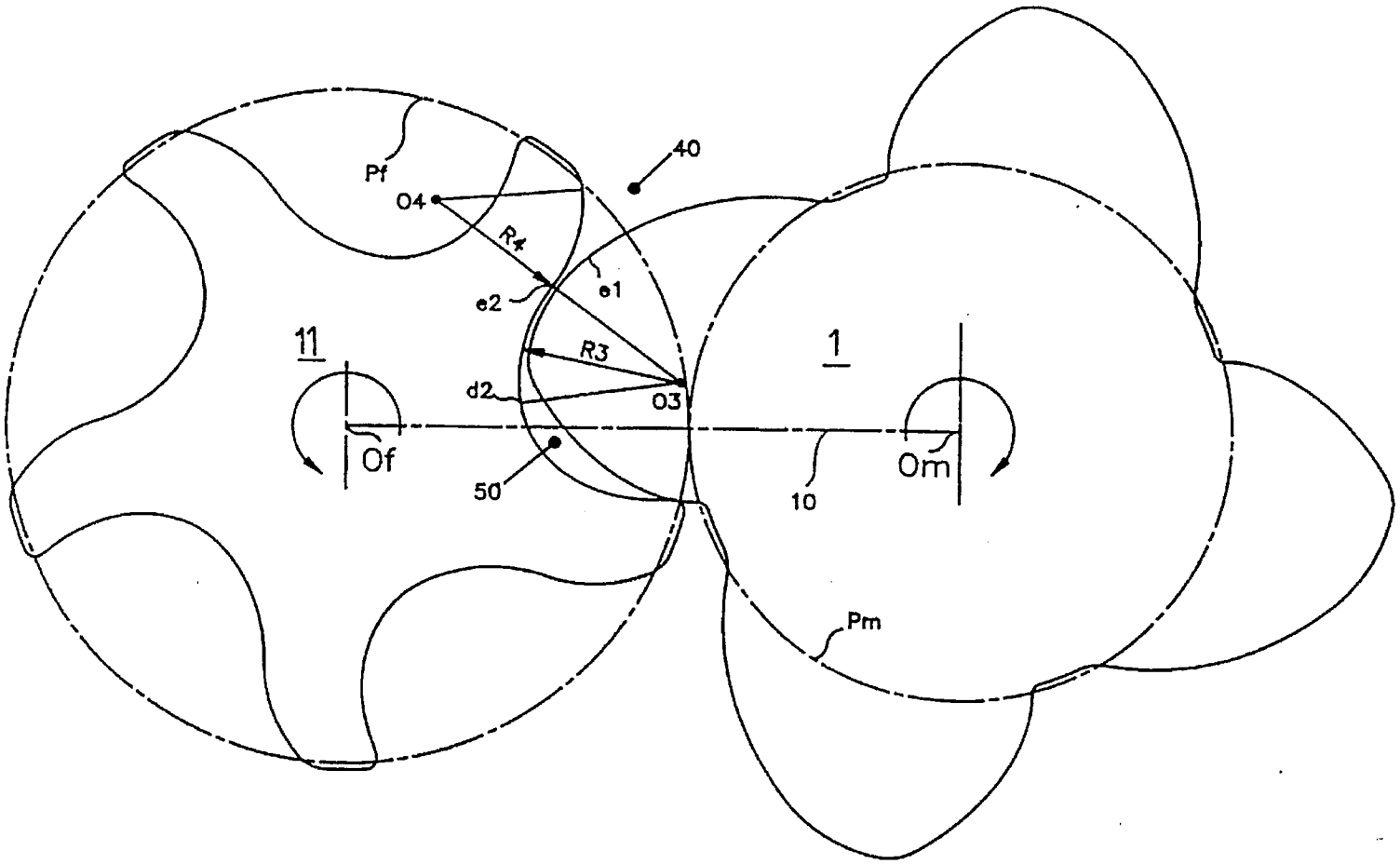
FIG. 3 is a view showing the male and female screw rotors of this invention meshing each other.

FIG. 1 is a view showing a tooth profile of a male screw rotor of this invention. This male screw rotor 1 has four helical lobes 2 and four grooves 3. In the above male rotor 1, the center of rotation and the pitch circle are represented by the characters Om and Pm respectively.

FIG. 2 is a view showing a tooth profile of a female screw rotor of this invention. This female screw rotor 11 has five helical lobes 12 and five grooves 13. In the above female rotor 11, the center of rotation and the pitch circle are represented by the characters Of and Pf respectively.

FIG. 3 is a view showing the male and female screw rotors 1 and 11 meshing each other. In this drawing, the male and female rotors 1 and 11 have rotated at an angle of about 10° from their common plane 10 on which the rotor's centers Om and Of of rotation are positioned.

1. Tooth profile of the male screw rotor

1) Leading-side tooth profile: from the tooth root to the tooth tip a) First curve (g1-f1): This curve is an envelope curve generated by the arc (g2-f2) of the female rotor's tooth profile. The first curve (g1-f1) is circumscribed with the root circle 45 at the point gl but tangent to the curve (e1-f1) at the point f1.

b) Second curve (f1-e1): This curve is an envelope curve generated by the arc (f2-e2) of the female rotor's tooth profile. The second curve (f1-e1) is tangent to the curve (d1-e1) at the point e1.

c) Third curve (e1-d1): This curve is an envelope curve generated by the arc (e2-d2) of the female rotor's the tooth profile. The third curve (e1-d1) is inscribed with the outside circle 55 of the male rotor 1 at the point d1.

2) Following-side tooth profile: from the tooth tip to the tooth root (a) First curve (d1-c1): This curve corresponding to a quadratic function provided by selecting the constants of a function $f(x)=ax^2+bx+c$ to achieve optimal constraint conditions. The selection of values for constants of the quadratic function are as follows.

(1) Constant "c": This constant "c" is approximately zero or is so relatively small that it may be assigned a value of zero from a practical standpoint.

Figure 4:
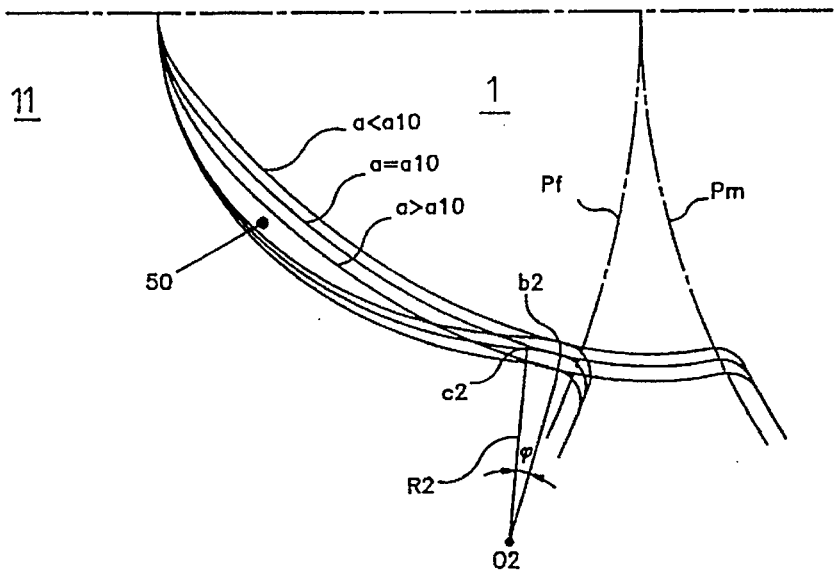
Figure 4:
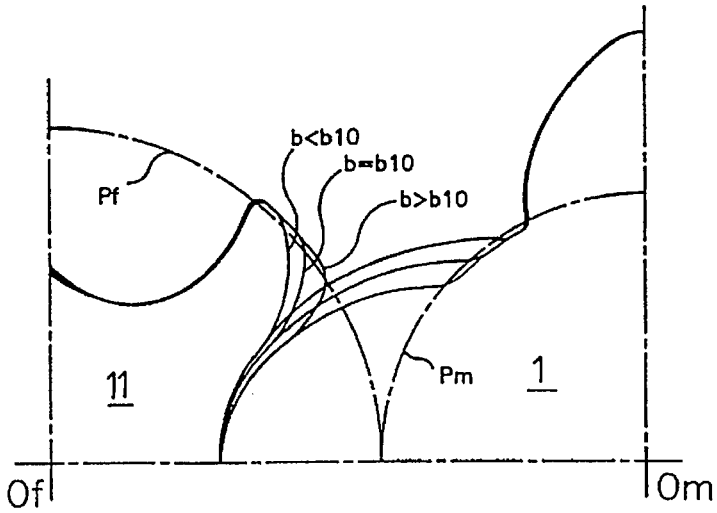
Figure 5:
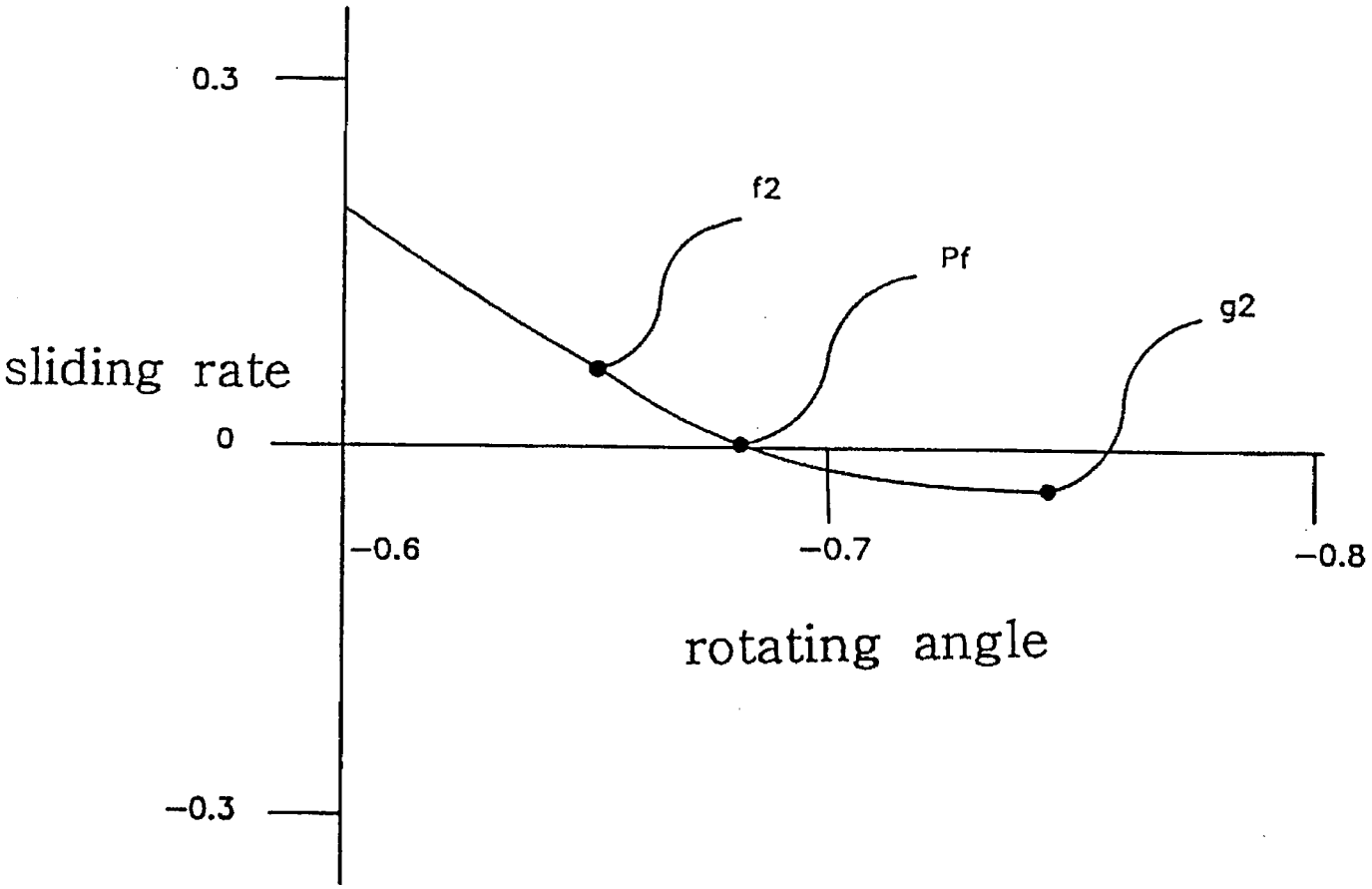
FIG. 5 is a graph representing the specific sliding of the female screw rotor of this invention.

(2) Constant "a": As represented in the graph of FIG. 4*a*, the constraint condition for selecting a value for the constant "a" is as follows. That is, the central angle (ϕ) for determining the size of the arc (c2-b2) of the female rotor defining the following-side sealing surface must be not less than 11° and, at the same time, the trapped pocket volume 50 (see FIG. 3), must be minimized.

The above constraint condition for selecting the constant "a" is for 1) reducing the amount of leaking fluid by enlarging the following-side sealing surface and 2) optimizing the operational performance of the compressor by minimizing the trapped pocket volume 50. This trapped pocket volume 50 may cause operational vibration and noise while the rotors 1 and 11 are operated.

The optimized value of the constant "a" is $a_{10}$. When the constant "a" is larger than the optimized value $a_{10}$, that is, when $a>a_{10}$, all of the sealing surface, the area of the blow hole and the trapped pocket volume 50 are reduced. However, when $a<a_{10}$, all of the sealing surface, the area of the blow hole and the trapped pocket volume 50 are enlarged.

In particular, the constant "a" has very little influence on the leading-side tooth profile but mainly influences the following-side tooth profile.

(3) Constant "b": As represented in the graph of FIG. 4*b*, the constraint conditions for selecting the constant "b" is as follows. That is, the minimum rib width of the female rotor 11 is not less than 15% of the radius of the outside circle 56 of the female rotor 11 and the cell area of the female rotor 11 is maximized and thereby maintaining the minimum strength while maximizing the volume.

The optimized value of the constant "b" is $b_{10}$. When the constant "b" is larger than the optimized value $b_{10}$, that is, when $b>b_{10}$, the rib width is increased while the volume is reduced. However, when $b<b_{10}$, the rib width is reduced while the volume is increased.

The above constant "b" has little influence on the following-side tooth profile but mainly influences the leading-side tooth profile.

When the constants of the above function $f(x)=ax^2+bx+c$ are selected as described above, the following advantages are achieved. That is, the sealing surface is increased, both the trapped pocket volume 50 and the blow hole area are reduced, the minimum rib width is achieved and the volume is increased.

Also, as the curvature of the above function gently varies, it is easy to machine the teeth of the screw rotors.

(b) Second curve (c1-b1): This curve is an envelope curve generated by the arc (c2-b2) of the female rotor's tooth profile. This second curve (c1-b1) cooperates with the following-side first curve (d2-c2) of the female rotor to form the trapped pocket volume 50.

(c) Third curve (b1-a1): This curve is an envelope curve generated by the arc (b2-a2) of the female rotor's tooth profile. This third curve (b1-a1) is circumscribed with the root circle 45 of the male rotor 1 at the point a1.

(d) Fourth curve (a1-g1): This curve is a part of the root circle 45 of the male rotor 1.

2. Tooth profile of the female screw rotor

1) Leading-side tooth profile: from the tooth tip to the tooth root (a) First curve (g2-f2): This curve is an arc having a radius R5. This first curve (g2-f2) is inscribed with the female rotor's outside circle 56 at the point g2 and with the arc (f2-e2) at the point f2.

The size of the radius R5 is an important parameter determining both the pressure angle and the specific sliding of the male and female rotors before and after the pitch circle Pf. The radius R5 has the value of (0.1~0.11)×Rf (Rf: radius of the female rotor's pitch circle). The center O5 of the arc (g2-f2) is positioned on a point having an interior angle of 42°–43° between the central line extending between the centers Om and Of of the two rotors 1 and 11 and a line extending from the center Of of the female rotor 11 to that point. In this embodiment, the radius R5 is set to let the specific sliding on the pitch circle Pf of the female rotor 11 almost become zero. When the specific sliding about the pitch circle Pf becomes lower, it is possible to achieve smooth power transmission and to reduce the operational vibration and noise. Therefore, both the mechanical efficiency and the durability of the rotors 1 and 11 are improved.

(b) Second curve (f2-e2): This curve is an arc having a radius R4. This arc (f2-e2) is circumscribed with the arc (d2-e2) at the point e2. The center O4 of the arc (f2-e3) is set to let the leading-side tooth profile of the female rotor 11 have an S-shaped profile.

(c) Third curve (e2-d2): This curve is an arc having a radius R3. The center 03 of this arc (e2-d2) is positioned in the inside of the pitch circle Pf of the female rotor 11. The position of the above center O3 is set by the constants of the function $f(x)=ax^2+bx+c$ defining the curve (d1-c1) of the male rotor's tooth profile.

At this time, as the center O3 is positioned in the inside of the pitch circle Pf of the female rotor 11 as described above, the leading-side tooth profile 25 of the male rotor 1 approaches the leading-side tooth profile 26 of the female rotor 11 and thereby reducing the amount of gas leaking through the suction side 40 as shown in FIG. 3.

2) Following-side tooth profile: from the tooth root to the tooth tip (a) First curve (d2-c2): This curve is a curve generated by the curve (d1-c1) of the male rotor's tooth profile.

(b) Second curve (c2-b2): This curve is an are having a radius R2. The center O2 of this arc (c2-b2) is positioned on the outside circle 56 of the female rotor 11. The central angle $\phi$ of the arc (c2-b2) is not less than 11°.

(c) Third curve (b2-a2): This curve is an arc having a radius R1. This arc (b2-a2) is inscribed with the arc (c2-b2) at the point b2 and with the outside circle 56 of the female rotor 11 at the point a2.

(d) Fourth curve (a2-g2): This curve is a part of the outside circle 56 of the female rotor 11.

The above tooth profile of the female rotor 11 has the following advantages.

(A) As the radius R5 of the arc (g2-f2) of the female rotor's tooth profile is set to let the specific sliding on the pitch circle Pf approach zero, the female rotor's tooth profile reduces power transmission loss as well as the operational vibration and noise and thereby improving adiabatic efficiency.

(B) As the center O3 of the arc (e2-d2) of the female rotor's tooth profile is positioned in the inside of the female rotor's pitch circle Pf, it is possible to minimize the amount of gas leaking from the high pressure side to the low pressure side of the compressor.

(C) As the constants of the function $f(x)=ax^2+bx+c$ defining the curve (d1-c1) of the male rotor 1 are selected to meet the constraint conditions such as the rib width, the trapped pocket volume, the sealing surface and the blow hole, the mechanical efficiency as well as volume efficiency of the compressor is improved.

Figure 6:
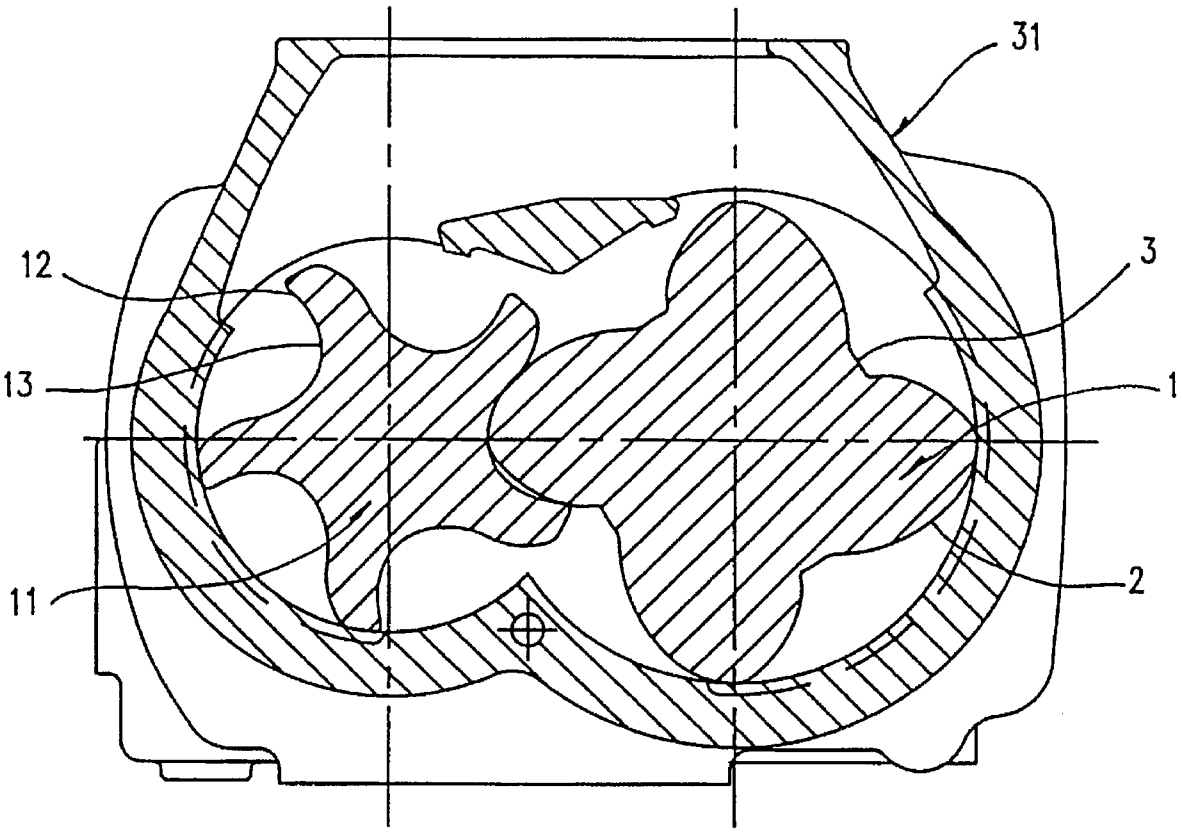
FIG. 6 is a sectional view of a compressor with the male and female screw rotors of this invention.

Turning to FIG. 6, there is shown a compressor with the aforementioned male and female screw rotors 1 and 11. In the above compressor, the female rotor 11 having the five lobes 12 and five helical grooves 13 rotates counterclockwise, while the male rotor 1 having the four lobes 2 and four helical grooves 3 rotates clockwise. Therefore, the screw rotors 1 and 11 of the compressor feed the compressible fluid while compressing the fluid in a casing 31.

As described above, the male and female screw rotors for compressors according to this invention have improved tooth profiles generated using a generation parameter of a quadratic function whose constants are selected to meet specified optimal constraint conditions. Therefore, the screw rotors of this invention enlarge the pressure angle and achieve good cutting condition. The rotors also reduce the trapped pocket volume to reduce the negative torque. The rotors further achieve relatively larger surface contact between the male and female rotors and thereby improve the sealing effect as well as the durability. Another advantage of the screw rotors of this invention is that the rotors minimize the specific sliding in the power transmission part, thus substantially reducing the operational vibration and noise of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A screw compressor comprising:

a male rotor having four lobes and four helical grooves, each of the lobes of the male rotor having a following side curve generated to meet a quadratic function $f(x)=a_{10}x^2+b_{10}x+c_{10}$; and a female rotor having five lobes and five helical grooves and being in mesh with the male rotor at a pitch circle, the lobes of the female rotor each having a leading-side first curve defining a trapped pocket with the following-side curve of the respective male rotor lobes, extending to an outer circle larger than the pitch circle, and having a rib width, the helical grooves of the female rotor defining a cell area between the lobes thereof, the leading-side first curve of the female rotor lobes being generated to become an arc, the radius and center of the arc allowing a specific sliding of the male rotor lobes about the pitch circle of the female rotor to approach zero;

wherein the constant $a_{10}$ of the quadratic function is of a value requiring the arc of the leading-side first curve of the female rotor to extend through at least 11° and minimizing the trapped pocket, the constant $b_{10}$ is of a value requiring a rib width of the female rotor lobes to be not less than 15% of the outside circle radius of the female rotor and to maximize the cell area between the lobes of the female rotor, and the constant $c_{10}$ is approximately zero.

2. The screw compressor of claim 1, wherein the arc of the leading-side first curve of the female rotor has a radius of (0.1~0.11)×the radius of the female rotor pitch circle, the center of the arc being positioned on a point having an interior angle of 42°–43° between a central line extending between the centers of the male and female rotors and a line extending from the center of the female rotor to that point.

3. The screw compressor of claim 1, wherein a leading-side third curve of said female rotor is an arc having a center positioned inside of the pitch circle of the female rotor.

* * * * *